US008366239B2

(12) United States Patent
Tachibana

(10) Patent No.: US 8,366,239 B2
(45) Date of Patent: Feb. 5, 2013

(54) IMAGE FORMING APPARATUS HAVING INK-MIST BLOCKING MECHANISMS

(75) Inventor: Eiji Tachibana, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 126 days.

(21) Appl. No.: 13/048,088

(22) Filed: Mar. 15, 2011

(65) Prior Publication Data

US 2011/0227999 A1 Sep. 22, 2011

(30) Foreign Application Priority Data

Mar. 16, 2010 (JP) ..... 2010-059798

(51) Int. Cl.
*B41J 2/165* (2006.01)

(52) U.S. Cl. ..... 347/34

(58) Field of Classification Search ..... 347/23, 347/25, 26, 34, 37
See application file for complete search history.

(56) References Cited

U.S. PATENT DOCUMENTS 7,699,417 B2 * 4/2010 Inoue ..... 347/8

FOREIGN PATENT DOCUMENTS

| | | |
|---|---|---|
| JP | 2001-191604 | 7/2001 |
| JP | 2007-326257 | 12/2007 |
| JP | 2008-260154 | 10/2008 |

* cited by examiner

*Primary Examiner* — Lamson Nguyen
(74) *Attorney, Agent, or Firm* — Cooper & Dunham LLP

(57) ABSTRACT

An image forming apparatus includes a printing head having an ink nozzle configured to discharge ink droplets onto a recording medium in order to form an image on the recording medium in a recording operation; a carriage on which the printing head is mounted and being moved in a main-scan direction during the recording operation; a linear encoder sheet having a counter for detecting a position of the carriage; an encoder sensor mounted on the carriage and detecting the position of the carriage by optically reading the counter of the linear encoder sheet; an carriage unit enclosure in which at least the carriage, the linear encoder sheet, and the encoder sensor are disposed; and an internal pressure adjusting unit adjusting an internal pressure of the carriage unit enclosure to be other than a negative pressure.

10 Claims, 14 Drawing Sheets

IMAGE FORMING APPARATUS HAVING INK-MIST BLOCKING MECHANISMS

BACKGROUND OF THE INVENTION

1. Field of the Invention

The present invention relates to image forming apparatuses having ink-mist blocking mechanisms.

2. Description of the Related Art

Image forming apparatuses include printers, facsimile machines, copy apparatuses, plotters, and multifunction peripherals, an inkjet recording apparatus is known. An inkjet apparatus is an image forming apparatus of a fluid-discharging type, which discharges ink droplets onto a sheet of recording material ("recording medium") from a recording head in a printing operation. In a serial type of an inkjet recording apparatus, the printing operation is performed while the printing head is moved in a direction ("main-scan direction") perpendicular to the direction of transport of the sheet ("sub-scan direction").

In the serial type of an inkjet recording apparatus, a mechanism for detecting the position of a carriage carrying the printing head and the amount of its movement is required for an accurate printing operation. In one example, the detection mechanism includes a linear encoder sheet. An inkjet recording apparatus of the serial type having such a detection mechanism using a linear encoder sheet is described below.

FIG. 13 is a plan view of a conventional inkjet recording apparatus of the serial type. The inkjet recording apparatus includes a carriage 1 on which plural printing heads 2 for discharging ink droplets are mounted. The carriage 1 is configured to be moved in the main-scan direction along a guide rod 5 by an endless timing belt 4 rotated by a motor 3. A linear encoder sheet 6 having a counter is disposed at least in a scanning area of the carriage 1 in the main-scan direction. The linear encoder sheet 6 is read by an encoder sensor 7 mounted on the carriage 1, and the scan position of the carriage 1 is detected by determining a count value read from the linear encoder sheet 6.

Each time the sheet 8 is transported by a transport mechanism 9 in the sub-scan direction by a predetermined distance, the carriage 1 is moved (or "scanned") while the printing head 2 discharges ink droplets onto the sheet 8, forming an image thereon. Thus, the linear encoder sheet 6 is installed near the carriage 1 such that it can be reliably read by the encoder sensor 7. More specifically, the linear encoder sheet 6 is exposed along the scanning area of the carriage 1.

In the serial type of an inkjet recording apparatus, as the ink droplets are discharged via the printing head nozzle, a mist of fine ink droplets is produced. The ink mist may become attached to various portions of the apparatus due to the flow of air caused by the scanning movement of the carriage or by an electrostatic attractive force, thus contaminating the apparatus. Particularly, the ink mist may become attached to the exposed surface of the linear encoder sheet over a long period. As a result, the encoder sensor may fail to read the linear encoder sheet accurately. Such a failure to detect the carriage position affects not only the resultant image formed on the recording medium, but may also prevent an appropriate control of the carriage 1. The failure to control the carriage 1 may result in the carriage 1, which may be moved at high speed, colliding with other components within the image forming apparatus, potentially breaking them and adversely affecting the reliability or durability of the apparatus.

In order to overcome such problems, various proposals have been made. For example, Patent Document 1 discusses installing the linear encoder sheet and the encoder sensor within a cylindrical carriage unit enclosure in order to prevent the ink mist from attaching onto the linear encoder sheet. Specifically, a magnet is provided to the encoder sensor and another magnet is also provided to the carriage facing the magnet on the encoder sensor. As the two magnets are magnetically coupled to each other via the cylindrical carriage unit enclosure member, the encoder sensor can be moved along with the carriage, thus enabling the detection of the carriage position.

Patent Document 2 discusses an inkjet recording apparatus that includes plural inlets disposed within an area of movement of the carriage, plural valves for individually opening or closing the inlets, and fans producing an airflow for guiding the ink mist toward the inlets. By activating the fans and opening the inlets by the valves, an airflow is produced between the fans and the inlets, by which the ink mist is guided and eventually collected, thus preventing the attaching of the ink mist onto the linear encoder sheet.

Patent Document 3 discusses a technology for preventing the flow of ink mist from the printing head to the linear encoder sheet. The technology involves producing an airflow from the linear encoder sheet toward the carriage by using an airflow producing unit.

In the technology of Patent Document 1, the carriage and the encoder sensor are separately installed. Thus, the technology cannot be applied to the typical structure illustrated in FIG. 15 where the encoder sensor is installed on the carriage. Further, the magnetic force of the magnets by which the encoder sensor and the carriage are magnetically coupled to each other may decrease over time to such an extent that the encoder sensor and the carriage cannot be accurately positioned with respect to each other. If that happens, the carriage position cannot be accurately detected.

In the case of Patent Document 2, the linear encoder sheet is installed near the airflow produced by the fans. As a result, the ink mist may become attached to the linear encoder sheet during the ink mist collecting operation. Thus, the problem of contamination of the linear encoder sheet is not overcome.

In the case of Patent Document 3, because the airflow produced by the airflow producing unit flows from where the linear encoder sheet is installed toward the carriage, the airflow produces an external force which is directly applied to the linear encoder sheet. As a result, the linear encoder sheet may be warped or distorted, thus preventing an accurate carriage position detection.

Patent Document 1: Japanese Laid-open Patent Publication No. 2007-326257

Patent Document 2: Japanese Laid-open Patent Publication No. 2008-260154

Patent Document 3: Japanese Laid-open Patent Publication No. 2001-191604

SUMMARY OF THE INVENTION

According to an embodiment, an image forming apparatus includes a printing head having an ink nozzle configured to discharge ink droplets onto a recording medium in order to form an image on the recording medium in a recording operation; a carriage on which the printing head is mounted and configured to be moved in a main-scan direction during the recording operation; a linear encoder sheet having a counter for detecting a position of the carriage; an encoder sensor mounted on the carriage and detecting the position of the carriage by optically reading the counter of the linear encoder sheet; an carriage unit enclosure in which at least the carriage, the linear encoder sheet, and the encoder sensor are disposed;

and an internal pressure adjusting unit adjusting an internal pressure of the carriage unit enclosure to be other than a negative pressure.

DETAILED DESCRIPTION OF THE PREFERRED EMBODIMENTS

In accordance with the embodiments of the present invention, the "image forming apparatus of the fluid discharging type" refers to an apparatus that performs an image forming operation by discharging a recording fluid onto a recording medium, such as an inkjet recording apparatus. The "recording medium" may include a sheet of various material, such as paper, thread, fiber, cloth, leather, metal, plastic, glass, wood, and ceramics. "Image formation (or recording)" may refer to the process of forming (or recording) not just an image with some apparent meaning, such as characters and figures, but also an image with apparently no meaning, such as a random pattern, on the recording medium. The "recording fluid" is not limited to ink but may include a DNA sample, a resist, and a patterning material. The "image" is not limited to two-dimensional images but may refer to an image formed on a three-dimensional object, or even a three-dimensional image.

Figure 1A:
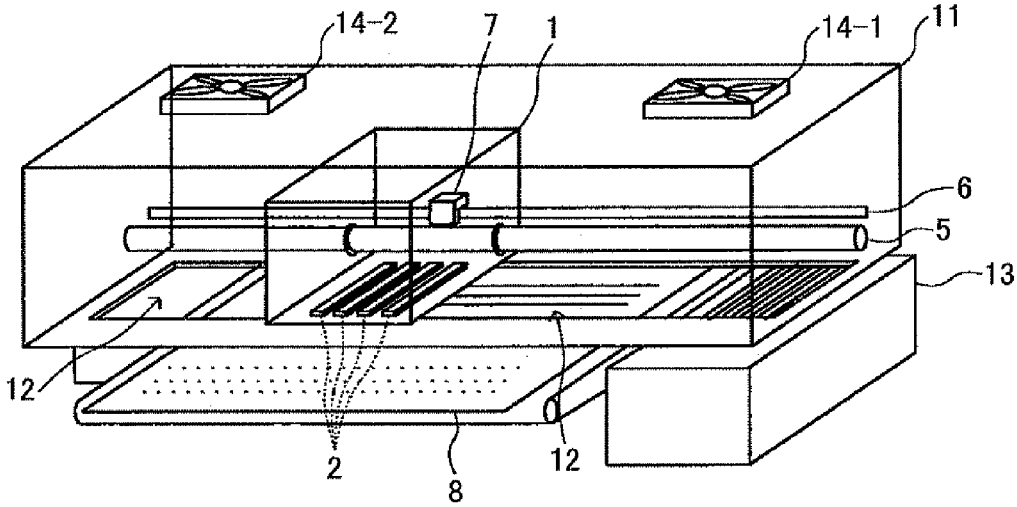
FIGS. 1A and 1B are a perspective view and a front view, respectively, of an image forming apparatus according to an embodiment of the present invention.
Figure 1B:
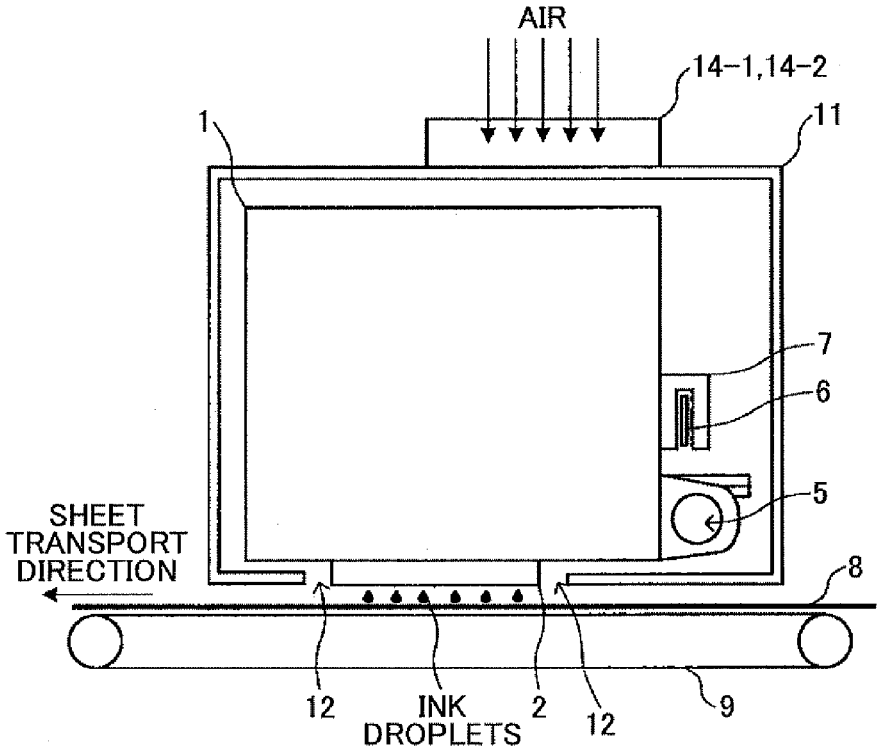

Referring now to the drawings, wherein like reference numerals designate identical or corresponding parts throughout the several views, FIGS. 1A and 1B are a perspective view and a side view, respectively, of an image forming apparatus according to an embodiment. The image forming apparatus includes a carriage unit enclosure 11 in which a carriage unit is disposed. The carriage unit includes a carriage 1 on which printing heads 2 are mounted, a guide rod 5, a linear encoder sheet 6, and an encoder sensor 7.

The carriage unit enclosure 11 has an opening portion 12 in an area corresponding to the area of movement of the printing head 2. The size of the opening portion 12 may correspond to at least a printed area of a sheet 8 and the size of an upper surface of a maintenance/recovery unit 13 that performs a maintenance or recovery operation on the printing head 2. On top of the carriage unit enclosure 11, fans 14-1 and 14-2 (either of which may be referred to as "the fan 14") for supplying the outside air into the carriage unit enclosure 11 are installed. By supplying the outside air, the fans 14-1 and 14-2 adjust the internal pressure of the carriage unit enclosure 11 so that the internal pressure of the carriage unit enclosure 11 does not reach a negative pressure state.

Other than the opening portion 12 in the area of movement of the printing heads 2, the carriage unit enclosure 11 has no opening via which a large amount of pressure may leak from within the carriage unit enclosure 11. Smaller openings may be present as long as they do not produce a significant pressure leak, such as openings for the mounting of the guide axle or the linear encoder sheet 6.

While the carriage unit enclosure 11 is described as an independent component in accordance with the present embodiment, the carriage unit enclosure 11 may be formed by a part of an exterior of the image forming apparatus or a frame member as long as the carriage unit can be hermetically sealed therein. Further, the fans 14-1 and 14-2 may be mounted on the sides of the image forming apparatus 100 instead of on the upper surface of the carriage unit enclosure 11 as illustrated in FIG. 1.

Thus, in the image forming apparatus, the internal pressure of the carriage unit enclosure 11 is increased compared to the outside by the operation of the fans 14-1 and 14-2. Thus, the ink mist produced by the printing heads 2 is prevented from entering the carriage unit enclosure 11. In this way, the contamination of the linear encoder sheet 6 disposed within the carriage unit enclosure 11 can be prevented.

Because the contamination by ink mist is prevented within the space of the carriage unit enclosure 11, the encoder sheet 6 and other components may be disposed in the same layout as that of a conventional apparatus. Further, because the contamination by ink mist is prevented not by blowing the mist using airflow but simply by creating the pressure difference between the inside and outside of the hermetically enclosed space, the number of fans or their capacity may be smaller than in the case of using an airflow. There is also no need for applying the airflow against the linear encoder sheet.

Figure 2:
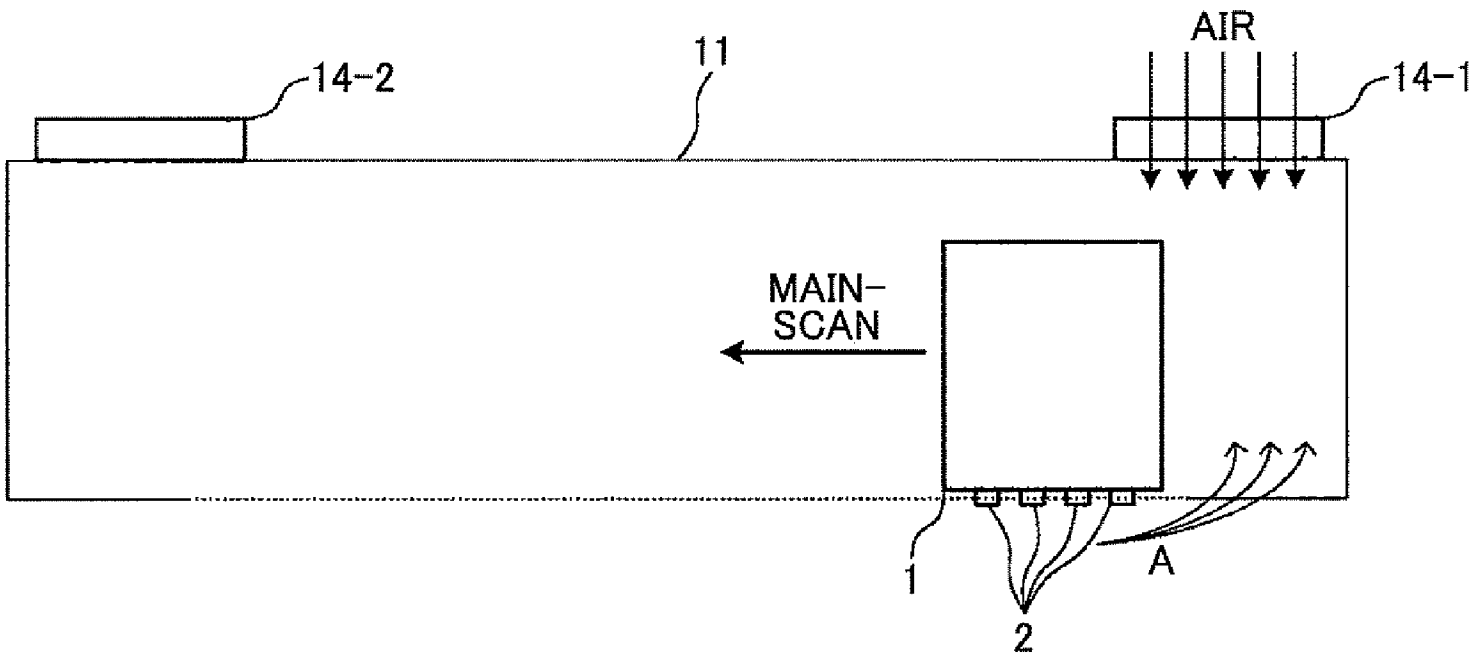
FIG. 2 is a cross section of a carriage unit enclosure of the image forming apparatus, illustrating the internal pressure of the carriage unit enclosure.

Next, an operation of the fans 14-1 and 14-2 is described. FIG. 2 is a schematic cross section of the carriage unit enclosure 11, illustrating the development of internal pressure. When the carriage 1 is moved at high speed in the main-scan direction as illustrated in FIG. 2, the internal pressure is reduced in an area "b" behind the carriage 1. The reduced pressure in the area b causes the ink mist to move up as illustrated by arrows A, thus increasing the probability of attachment of the ink mist within the carriage unit enclosure 11.

Thus, in this case, the fan 14-1 disposed behind the carriage 1 is activated to supply air into the area b, thus preventing the decrease in pressure in the area b and the entry of ink mist into the carriage unit enclosure 11. Such an upward airflow tends to occur more frequently at the point of change in operation of the carriage, such as at the point of reversal of scan direction or at the ends of the internal space of the carriage unit enclosure 11. Thus, the fans 14-1 and 14-2 may preferably be disposed at the ends of the area of movement of the carriage 1. Preferably, the fans 14-1 and 14-2 (either of which may be referred to as "the fan 14" hereafter) may be installed on the sides of the carriage unit enclosure 11.

Figure 3:
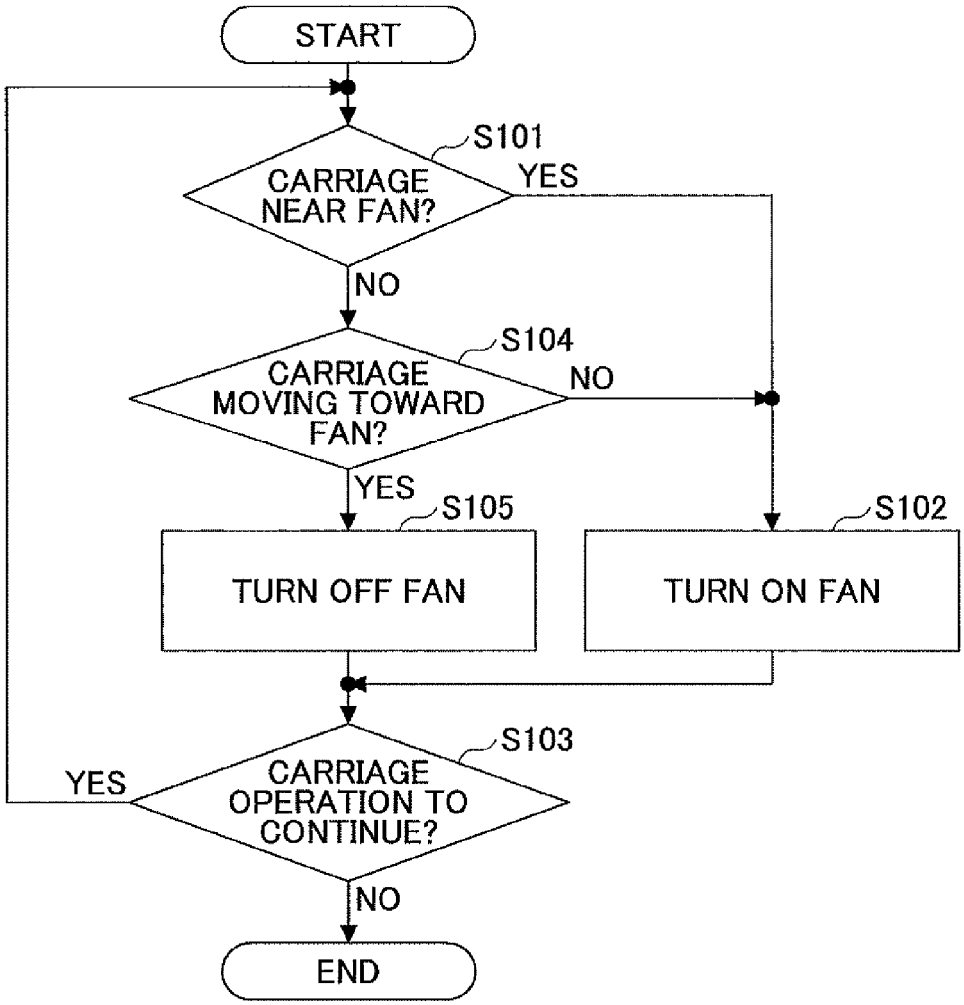
FIG. 3 is a flowchart of a fan operation control process according to an embodiment.

Next, the operation of the fans 14-1 and 14-2 is described with reference to FIGS. 1 and 3. As illustrated in FIG. 1, the position and direction of movement of the carriage 1 are constantly detected by the encoder sensor 7 in combination with the linear encoder sheet 6. Referring to a flowchart of FIG. 3, after the position of the fan 14 is defined, it is determined whether the scanning position of the carriage 1 is near the fan 14 (step S101). When the scanning position of the carriage 1 is near the fan 14 ("Yes" in S101), the fan 14 is activated (step S102). It is then determined whether the carriage 1 is to be further moved (step 103). If the carriage 1 is not to be moved further ("No" in step 103), the process ends. If the carriage 1 is to be moved further ("Yes" in step 103), the routine goes back to step S101.

When the position of the carriage 1 is not near the fan 14 ("No" in step S101), it is determined whether the direction of movement of the carriage 1 is toward or away from the fan 14 (step S104). When the direction of movement of the carriage 1 is not toward the fan 14 ("No" in step S104), the fan 14 is activated (step S102). When the direction of movement of the carriage 1 is toward the fan 14 ("Yes" in step S104), the fan 14 is turned off (step S105).

Figure 4:
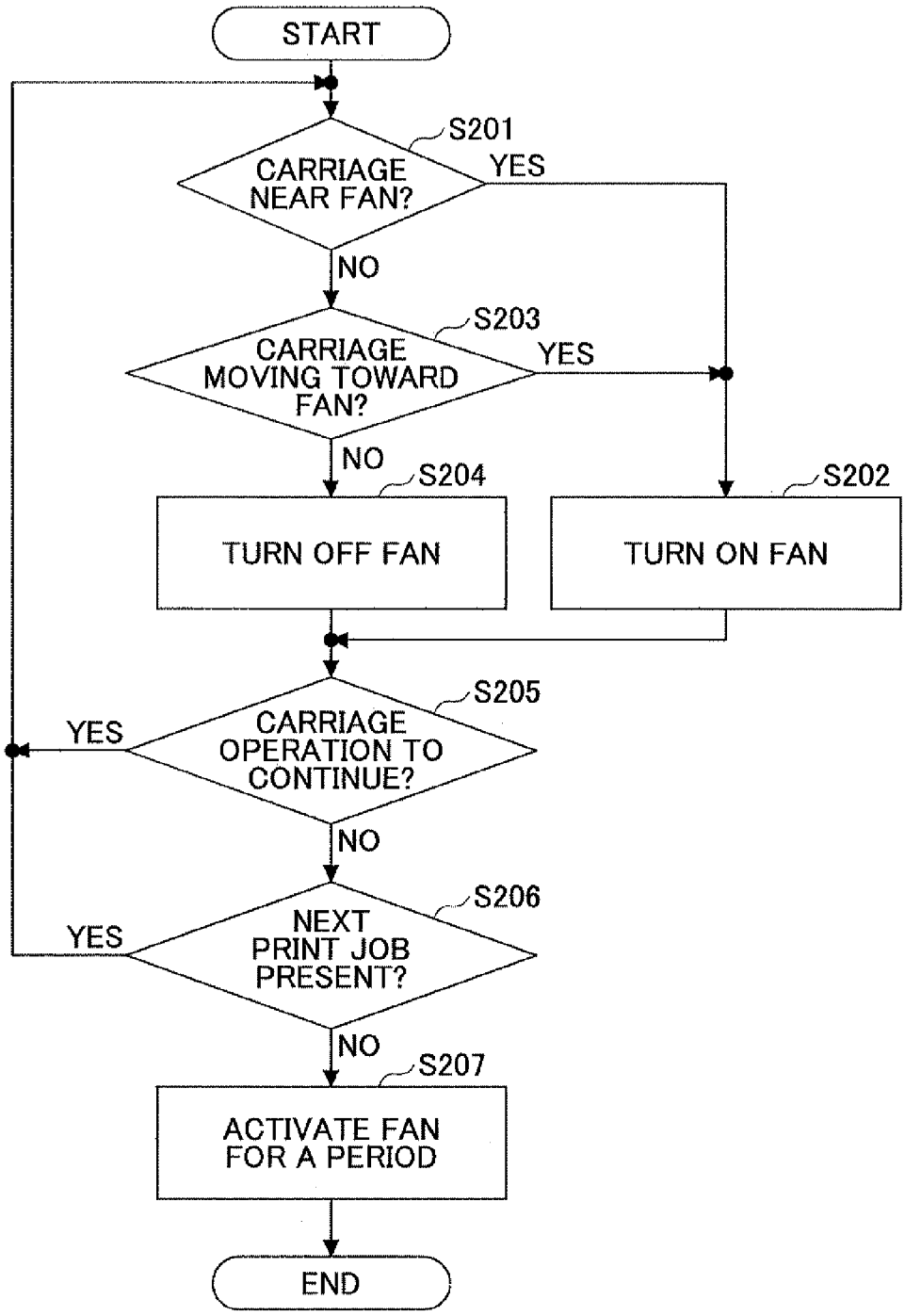
FIG. 4 is a flowchart of a fan operation control process according to another embodiment.

By this operation, the generation of negative pressure within the carriage unit enclosure 11 by the movement of the carriage 1 can be prevented, thus preventing the entry of ink mist into the carriage unit enclosure 11. Because there is no need to activate plural fans at all times, an efficient fan operation can be realized. The ink mist may remain floating within the image forming apparatus even after the printing operation and the carriage 1 is stopped. Thus, preferably, the fan 14 may be continuously activated for a certain period of time even after the printing operation, as illustrated in step S207 of an operation flow of FIG. 4.

Figure 5A:
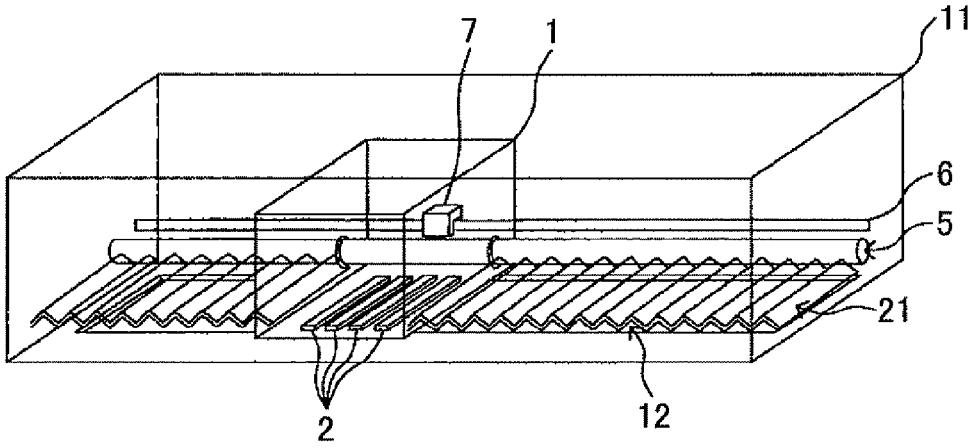
FIGS. 5A and 5B are a perspective view and a cross section, respectively, of an image forming apparatus according to an embodiment.
Figure 5B:
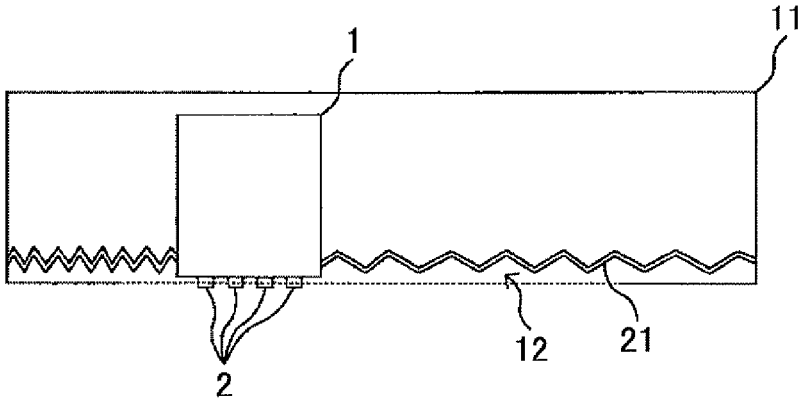

FIGS. 5A and 5B are a perspective view and a front view, respectively, of the image forming apparatus according to another embodiment. In accordance with the present embodiment, the sides of the carriage 1 are connected with the corresponding internal sides of the carriage unit enclosure 11 via a bellows member 21 as an example of a flexible shielding member installed on or above the opening portion 12. The bellows member 21 is capable of being expanded or contracted in accordance with the movement of the carriage 1 in the main-scan direction. Thus, the opening portion 12 of the carriage unit enclosure 11 can be covered at all times even when the carriage 1 is moved, so that the entry of ink mist into the carriage unit enclosure 11 via the opening portion 12 can be prevented. The bellows member 21 may be installed on an existing apparatus with only a minimum modification, thus providing a high degree of versatility. Preferably, the bellows member 21 may be made of a highly flexible material, such as rubber.

Figure 6A:
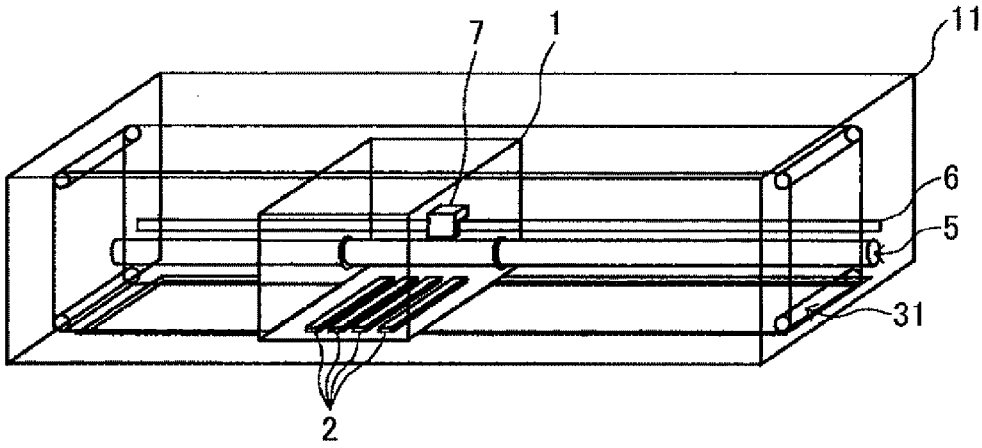
FIGS. 6A and 6B are a perspective view and a cross section, respectively, of an image forming apparatus according to an embodiment.
Figure 6B:
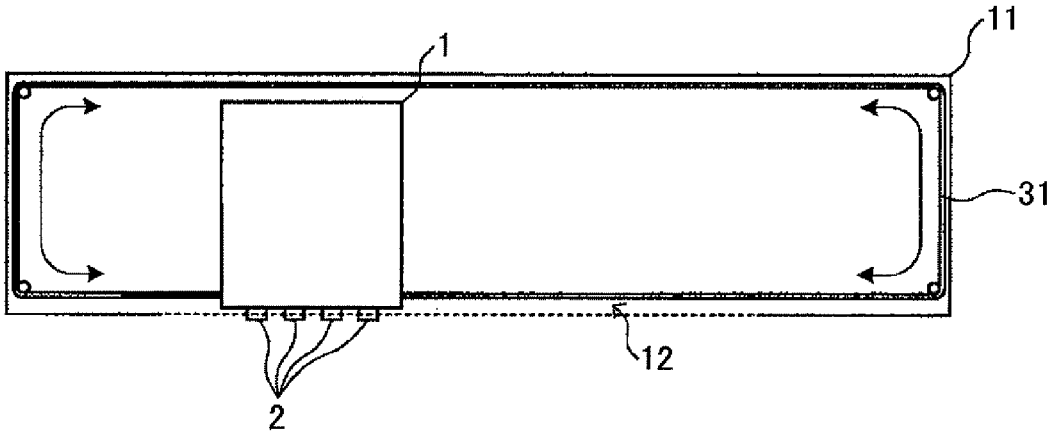

FIGS. 6A and 6B are a perspective view and a front view, respectively, of an image forming apparatus according to another embodiment. According to the present embodiment, a rotatable sheet member 31 as an example of the flexible shielding member is extended above the carriage 1, with the ends of the sheet member 31 attached to the corresponding sides of the carriage 1 via two rollers 32 attached on each internal side of the carriage unit enclosure 11. Thus, the carriage 1 is encircled by the sheet member 31 when seen from the sub-scan direction, as illustrated in FIG. 6B. Because the sheet member 31 is attached to the carriage 1, the sheet member 31 can be rotated as the carriage 1 is moved back and forth in the main-scan direction. Thus, the opening portion 12 of the carriage unit enclosure 11 can be covered at all times even when the carriage 1 is moved, thus effectively preventing the entry of ink mist into the carriage unit enclosure 11 via the opening portion 12.

Figure 7A:
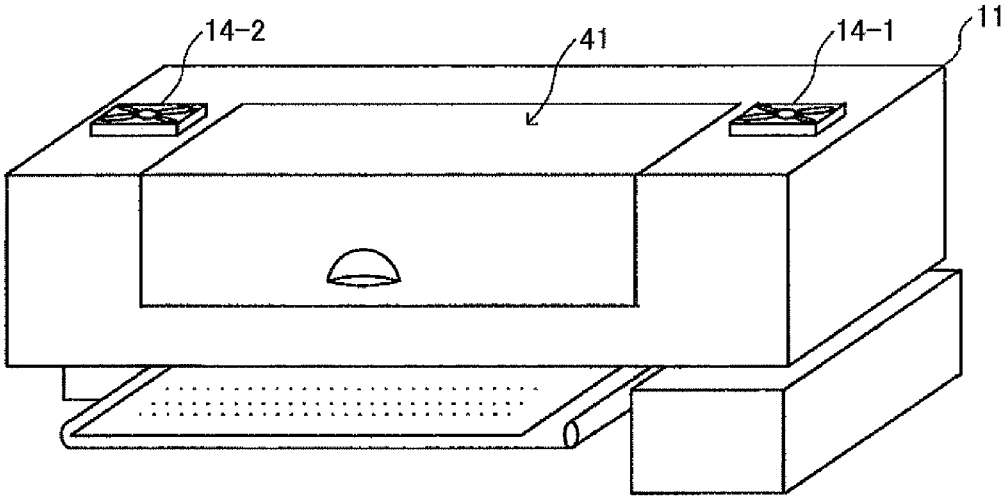
FIGS. 7A and 7B are perspective views of an image forming apparatus according to an embodiment.
Figure 7B:
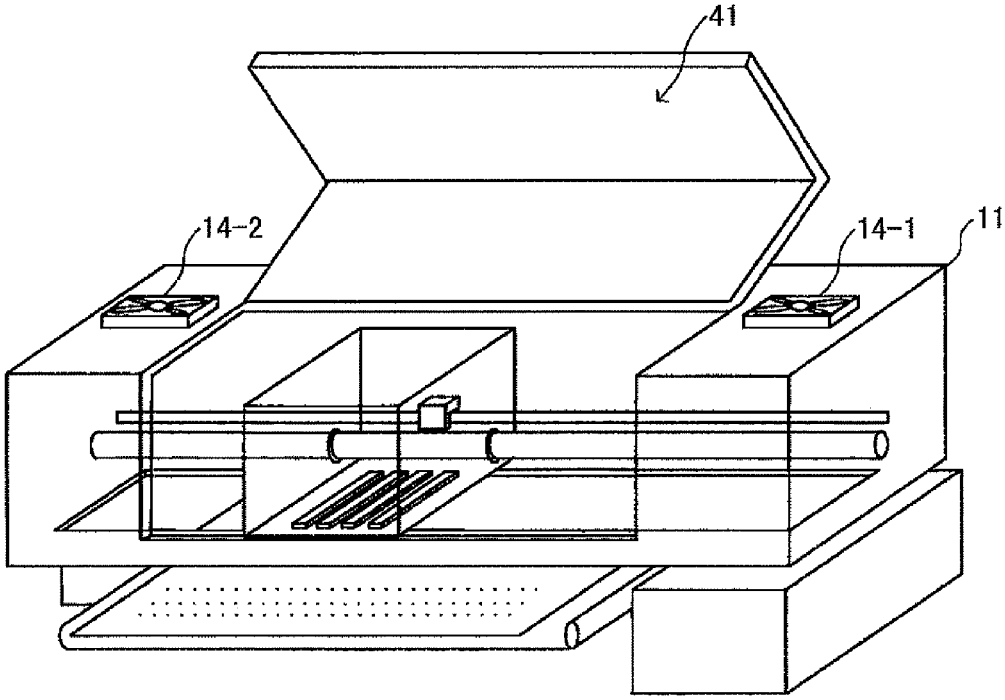

FIGS. 7A and 7B illustrate an image forming apparatus according to another embodiment. FIG. 7A is an overall perspective view of the image forming apparatus. FIG. 7B is a perspective view of the image forming apparatus with an open/close cover 41 of the carriage unit enclosure 11 opened. During the scanning operation of the carriage 1 in the printed area, a sheet with a bend or warping may cause a jam, requiring access to the carriage 1. Also, it is preferable to be able to easily access the carriage 1 for replacement of the printing head or ink cartridges mounted on the carriage 1. The open/close cover 41 of the carriage unit enclosure 11 provides easy access to the carriage 1 for replacement or maintenance, as illustrated in FIG. 7B.

Figure 8A:
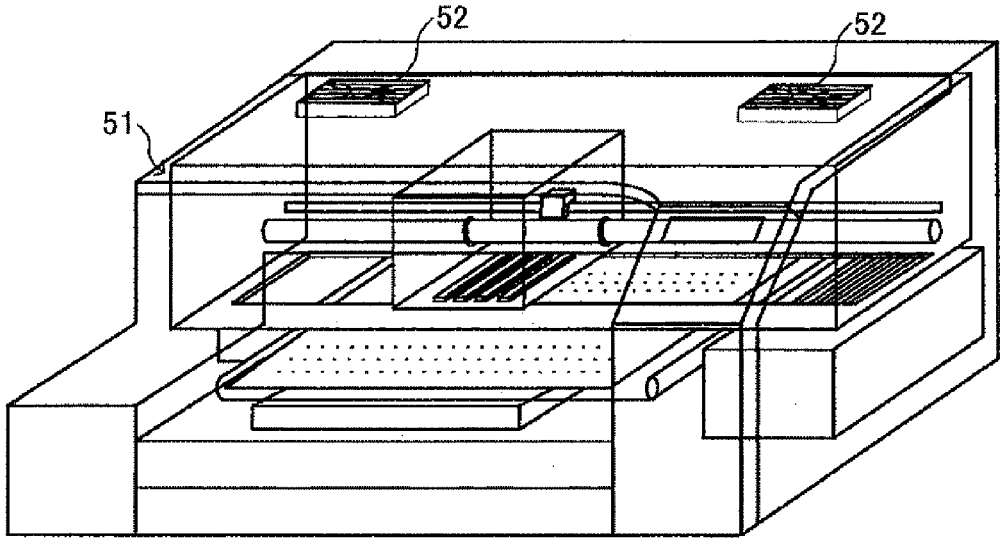
FIGS. 8A and 8B are perspective views of an image forming apparatus according to an embodiment.
Figure 8B:
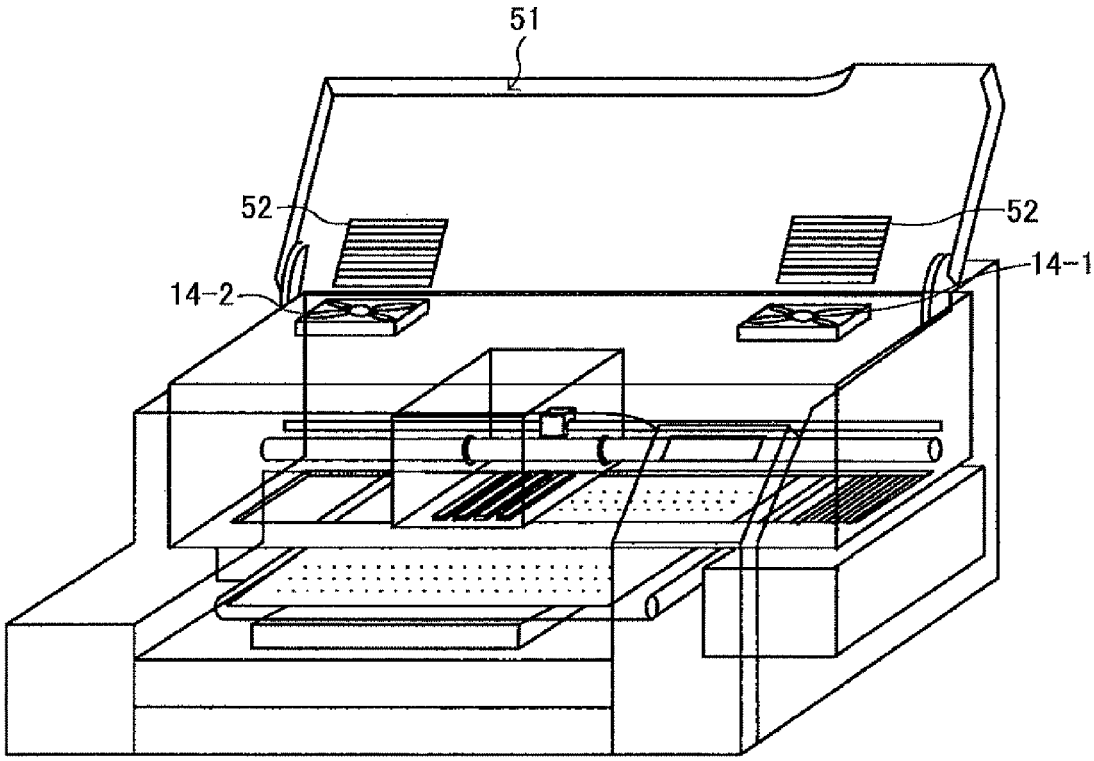

FIGS. 8A and 8B are perspective views of an image forming apparatus according to another embodiment, which includes an exterior cover 51 which may be openable. The exterior cover 51 has vent openings 52 for enabling the effective supply of outside air into the carriage unit enclosure 11 by the fans, as better illustrated in FIG. 8B where the exterior cover 51 is in an open status.

Figure 9A:
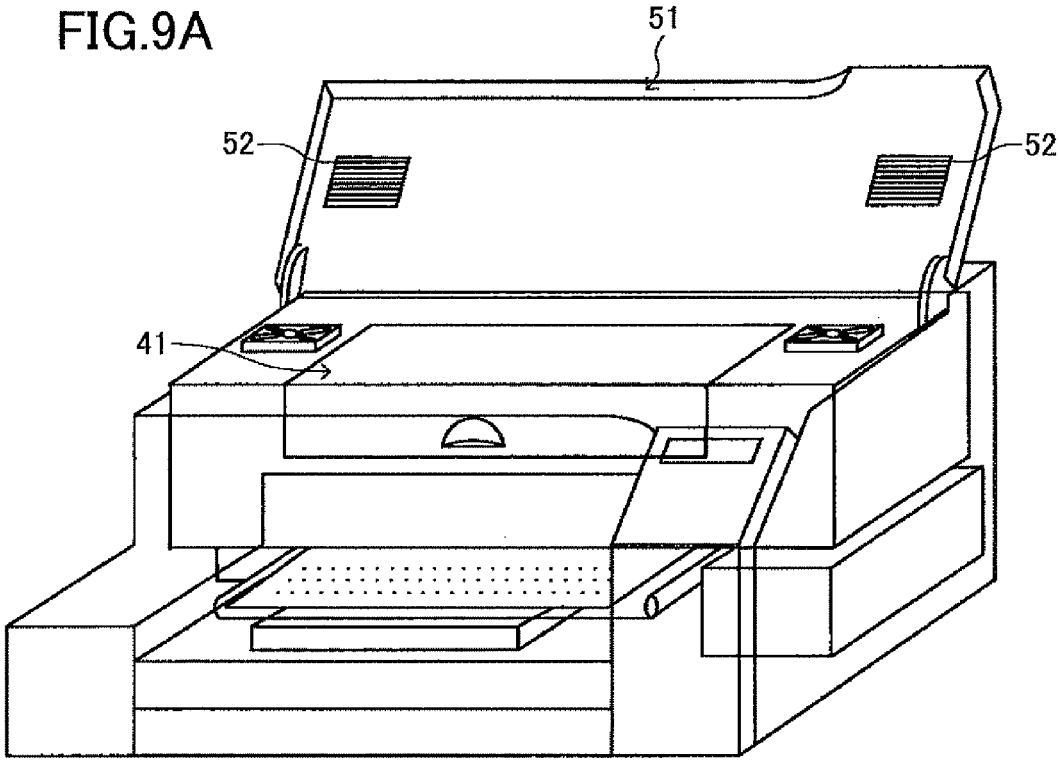
FIGS. 9A and 9B are perspective views of an image forming apparatus according to an embodiment.
Figure 9B:
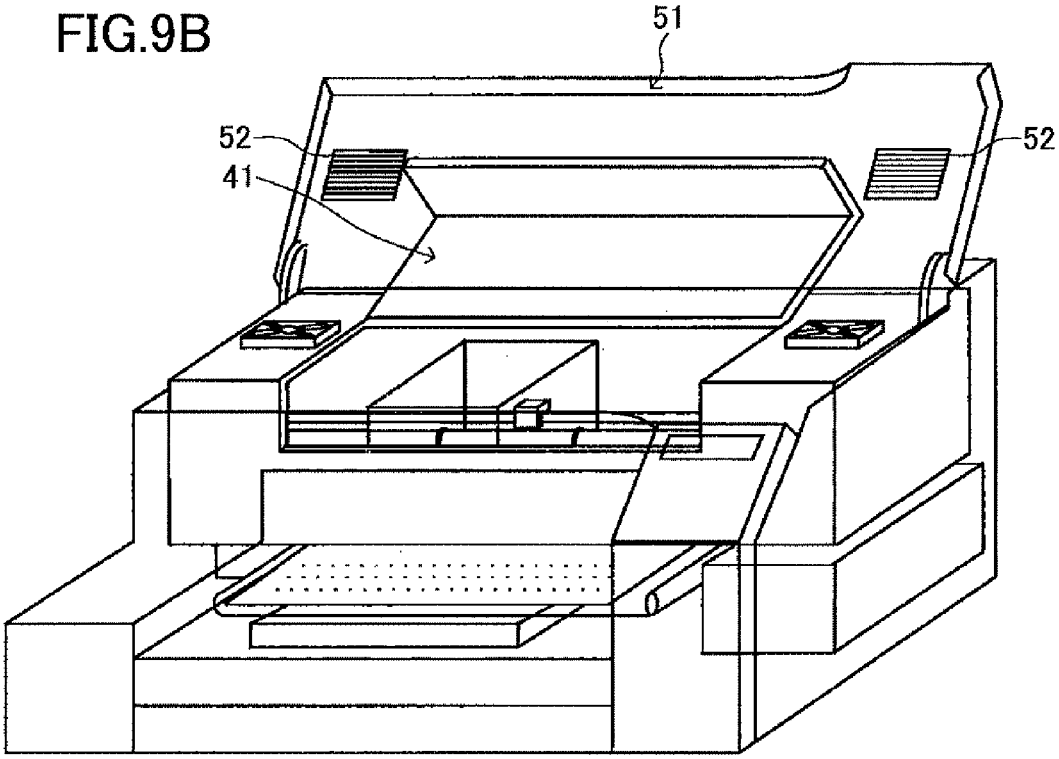

FIGS. 9A and 9B are perspective views of an image forming apparatus according to another embodiment, which includes the exterior cover 51 and in which the carriage unit enclosure 11 includes the open/close cover 41 as according to the embodiment of FIGS. 7A and 7B.

Figure 10A:
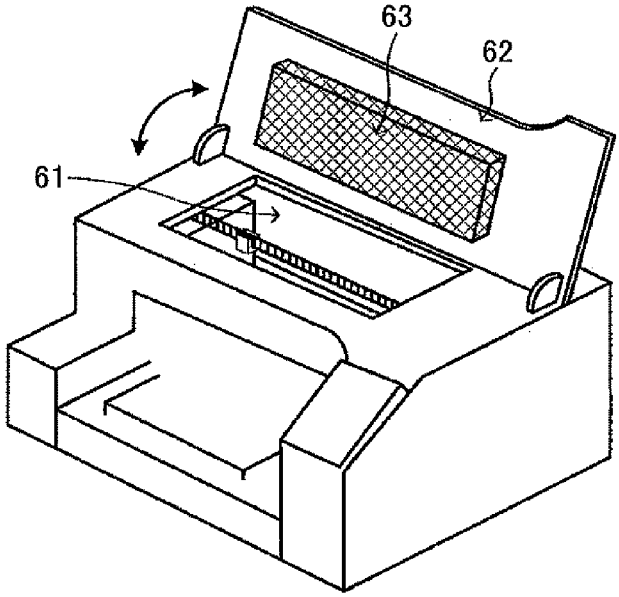
FIGS. 10A, 10B, and 10C illustrate an image forming apparatus according to an embodiment.
Figure 10B:
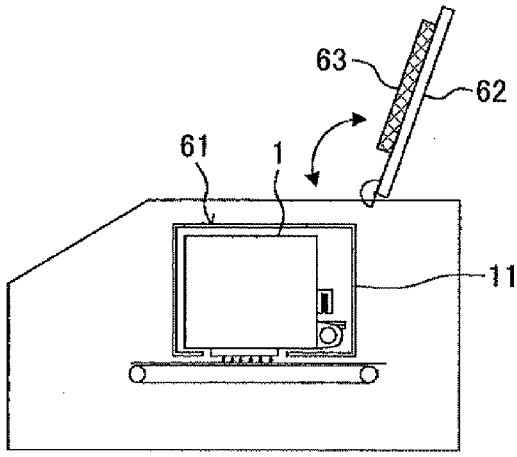
Figure 10C:
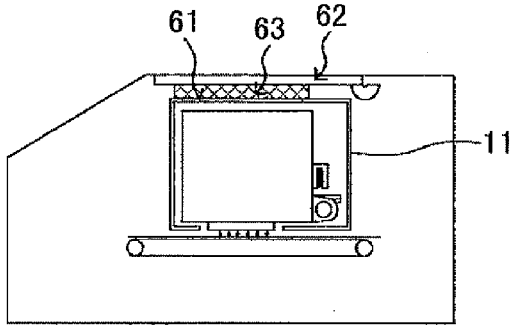

FIGS. 10A, 10B, and 100 illustrate an image forming apparatus according to another embodiment. FIG. 10A is a perspective view, and FIGS. 10B and 10C are lateral cross sections. In accordance with the present embodiment, the carriage unit enclosure 11 includes an opening portion 61 in its top surface, which may be used for maintenance purposes. The opening portion 61 is closed by a casing cover 62 attached to the apparatus main body. When the casing cover 62 is closed as illustrated in FIG. 10C, the opening portion 61 is hermetically closed by a resilient member 63 provided on a back surface of the casing cover 62, thus hermetically sealing the carriage unit enclosure 11. Thus, in accordance with the present embodiment, the carriage unit enclosure 11 may not have an open/close cover of its own, thus reducing the total number of components of the image forming apparatus.

Figure 11A:
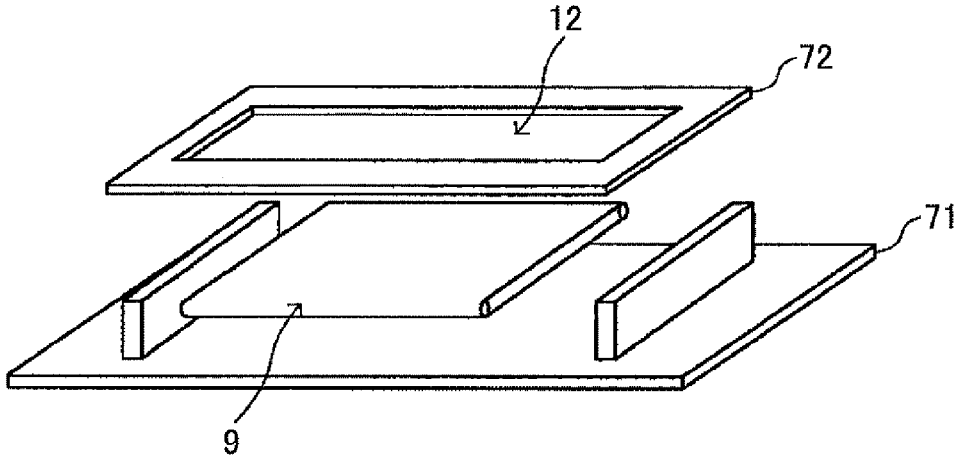
FIGS. 11A through 11F illustrate steps of an assembly process of an image forming apparatus according to an embodiment.
Figure 11B:
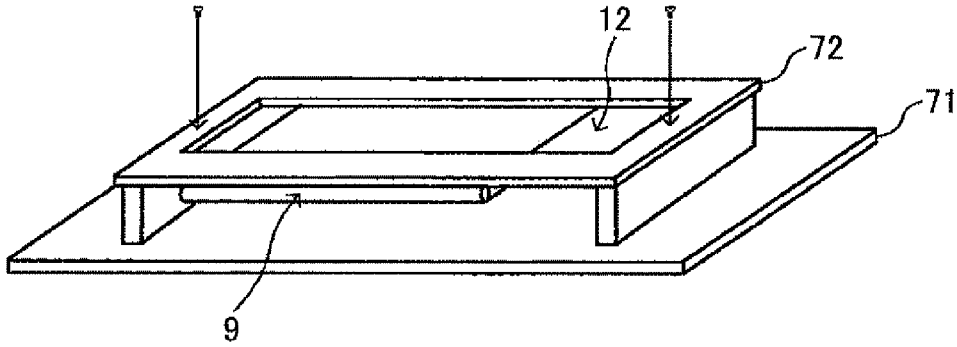

Next, an assembly process of the image forming apparatus according to an embodiment is described with reference to FIGS. 11A through 11F. As illustrated in FIGS. 11A and 11B, a transport unit 9 is attached to a base portion 71. On top of the transport unit 9, a lower main-scan-unit casing member 72 is attached to the base portion 71 with a fastening device, such as screws or glues. The lower main-scan-unit casing member 72 has the opening portion 12 corresponding to the area of movement of the printing head.

Figure 11C:
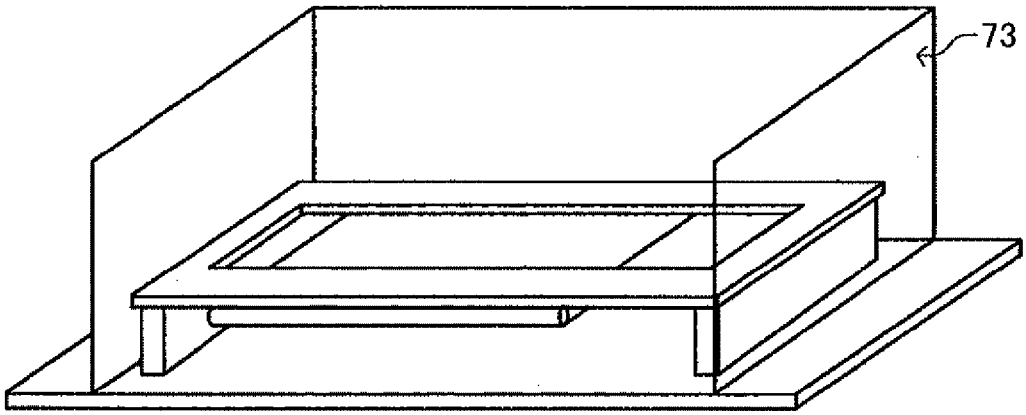
Figure 11D:
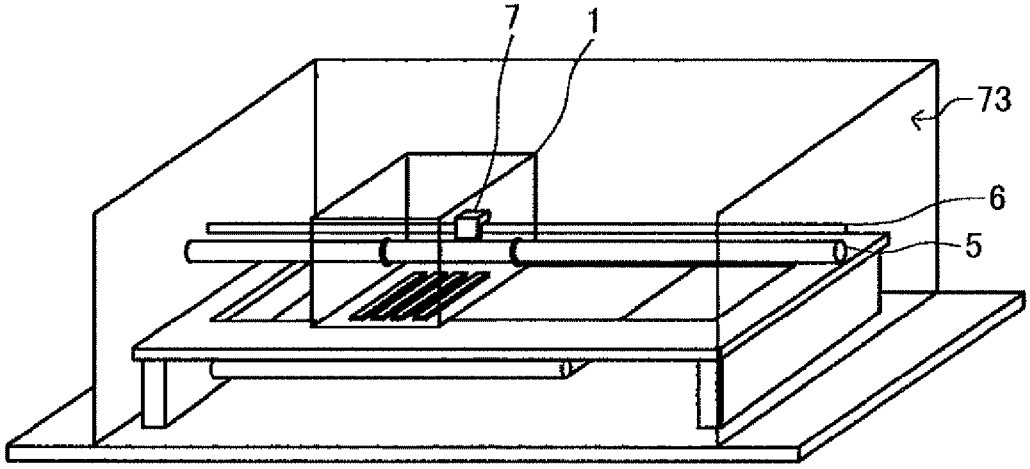
Figure 11E:
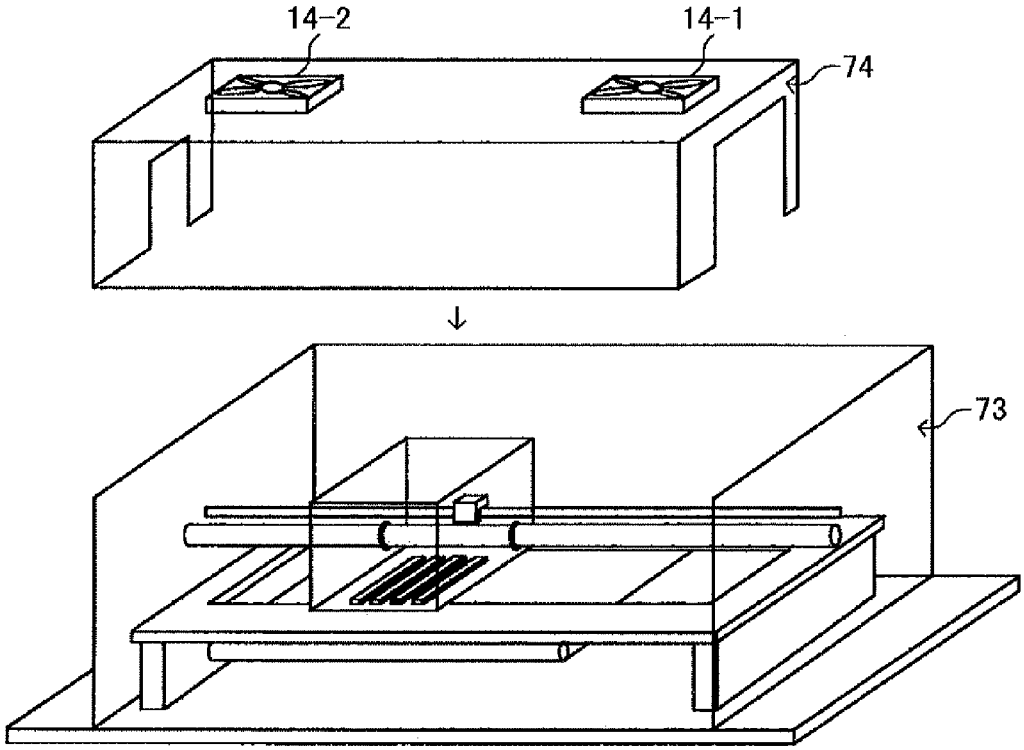
Figure 11F:
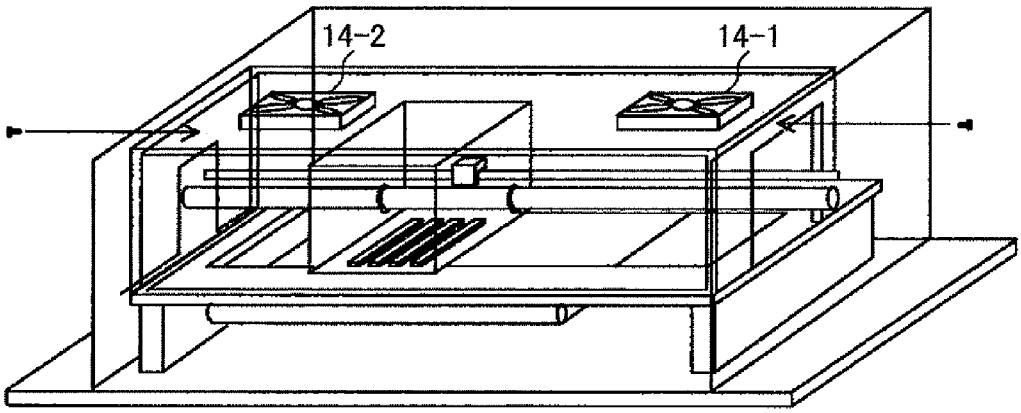

Then, as illustrated in FIG. 11C, a frame member 73 is attached. Alternatively, the frame member 73 may be attached prior to the mounting of the transport mechanism 9. Thereafter, the carriage unit is attached to the left and right sides of the frame member 73, as illustrated in FIG. 11D, and a top main-scan-unit casing member 74 is mounted, as illustrated in FIG. 11E.

During this assembly process, the distance between the transport mechanism 9 and the carriage unit is important. Thus, in accordance with the present embodiment, the position of the carriage unit relative to the transport mechanism 9 may be made adjustable. The main-scan-unit casing (72, 74) may be preferably mounted with a certain degree of freedom in order to minimize the amount of modification in the existing system. For this purpose, the main-scan-unit casing is divided into the lower main-scan-unit casing member 72 and the main-scan-unit casing upper member 74, and the main-scan unit lower member 72 is positioned first with respect to the transport mechanism 9.

The top main-scan-unit casing member 74 includes a clearance portion to clear the area of connection of the carriage unit and the frame member 73. After the position of the carriage 1 is determined, the top main-scan-unit casing member 74 is mounted. Because the position of the main-scan-unit casing and that of the carriage 1 are separately determined, the position of the carriage 1 may be adjusted by adjusting the location of mounting of the carriage unit to the frame member 73. In accordance with the present embodiment, the main-scan-unit casing is attached with its sides in intimate contact with the left and right sides of the frame members 73, so that the clearance portion can be covered by the frame member 73. Thus, the hermetically sealed state of the carriage unit enclosure 11 can be maintained in spite of the clearance portions of the top main-scan-unit casing member 74.

Figure 12:
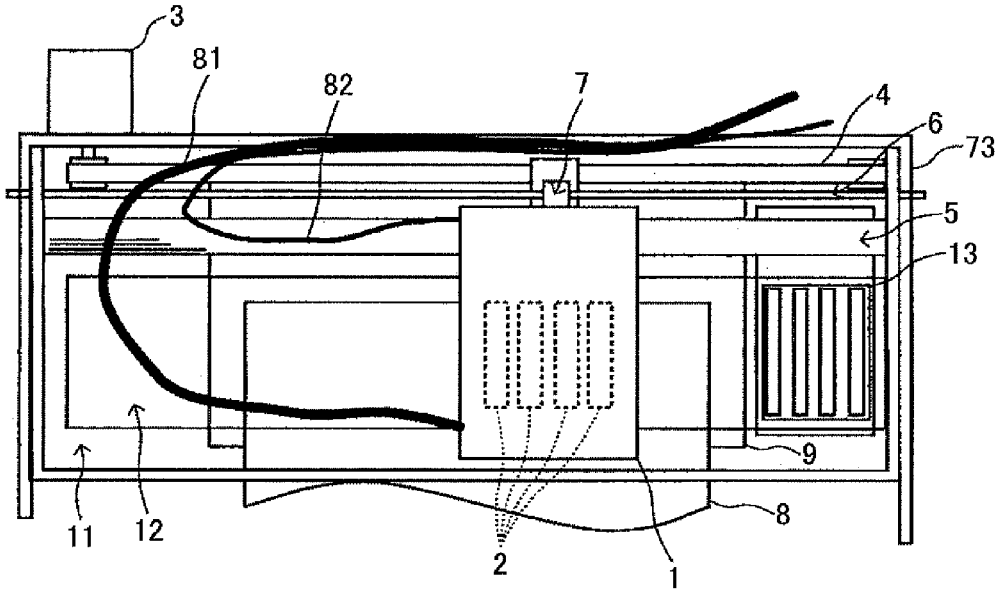
FIG. 12 illustrates an image forming apparatus to which a harness and an ink tube are connected from the outside of the apparatus main body.
Figure 13:
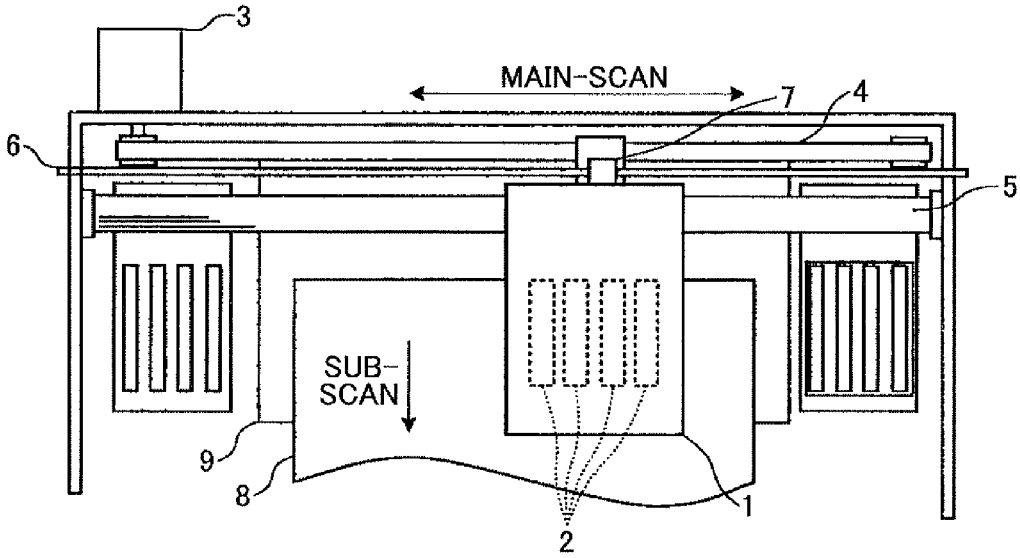
FIG. 13 is a plan view of a conventional serial type inkjet printer.

Harnesses and ink tubes from the apparatus main body may be connected to the carriage 1 for controlling the printing head. FIG. 12 illustrates an example in which an ink tube 81 connected to the ink head on the carriage 1 and a harness 82 connected to the printing head 2 of the carriage 1 are connected, via a rear portion of the frame member 73, to a control substrate and an ink supply unit, respectively (both of which not illustrated) disposed outside the frame portion 73. By installing the main-scan-unit casing in intimate contact with the rear surface and the left and right side surfaces of the frame member 73, the opening portion 12 is enclosed by the frame member 73. Thus, the ink tube 81 and the harness 82 can be connected to the carriage 1 while the sheet transport area in which ink mist may be present is separated from the inside of the main-scan-unit casing.

Thus, in accordance with the embodiment illustrated in FIG. 1, at least the carriage 1, the linear encoder sheet 6, and the encoder sensor 7 are disposed within the carriage unit enclosure 11. The internal pressure of the carriage unit enclosure 11 may become negative in some areas due to the scan operation of the carriage 1, causing the entry of ink mist. Thus, the fans 14-1 and 14-2 (internal pressure adjusting unit) are configured to forcibly supply air into the carriage unit enclosure 11 to prevent the negative pressure within the carriage unit enclosure 11. In this way, the entry of ink mist into the carriage unit enclosure 11 is prevented, thus preventing the contamination of the linear encoder sheet 6 by the ink mist. Further, in accordance with the present embodiment, because the encoder sensor 7 is mounted on the carriage 1 that is scanned along and near the linear encoder sheet 6, the position of the carriage 1 can be accurately detected.

In accordance with another embodiment, the opening portion 12 of the carriage unit enclosure 11 is covered by the flexible shielding member, such as the bellows member 21 illustrated in FIG. 5 or the rotatable sheet member 31 illustrated in FIG. 6. The flexible shielding member is configured to be moved in accordance with the scanning movement of the carriage 1. Thus, the opening portion 12 of the carriage unit enclosure 11 can be hermetically sealed at all times even during the scanning operation of the carriage 1, thus preventing the entry of ink mist into the carriage unit enclosure 11 and preventing the contamination of the linear encoder sheet 6.

As illustrated in FIG. 2, when a negative pressure state develops in the area behind the carriage 1 in the carriage unit enclosure 11, the ink mist may enter into the negative pressure state area. Thus, the fans 14-1 and 14-2 (internal pressure adjusting unit) are provided at the lateral ends of the carriage unit enclosure 11, and one of the fans 14-1 and 14-2 that is located in the rear of the carriage 1 in a direction of scan operation is activated in order to supply air into the rear area, thereby eliminating the negative pressure state in the carriage unit enclosure 11. Thus, the entry of ink mist into the carriage unit enclosure 11 and the resultant contamination of the linear encoder sheet 6 can be prevented.

Within the image forming apparatus, the ink mist may remain floating even after the printing operation. Thus, in accordance with an embodiment, the fans 14-1 and 14-2 may be continuously operated for a period of time after the printing operation in order to prevent the entry of the floating ink mist into the carriage unit enclosure 11.

Preferably, the carriage unit enclosure 11 may be provided with an open/close cover for the purpose of replacement or maintenance of the printing head and the like. The open/close cover may be provided by a part of the exterior member of the image forming apparatus. In this case, the number of components of the image forming apparatus may be reduced.

Although this invention has been described in detail with reference to certain embodiments, variations and modifications exist within the scope and spirit of the invention as described and defined in the following claims.

The present application is based on Japanese Priority Application No. 2010-059798 filed Mar. 16, 2010, the entire contents of which are hereby incorporated by reference.

What is claimed is:

1. An image forming apparatus comprising:

a printing head having an ink nozzle configured to discharge ink droplets onto a recording medium in order to form an image on the recording medium in a recording operation;

a carriage on which the printing head is mounted and configured to be moved in a main-scan direction during the recording operation;

a linear encoder sheet having a counter for detecting a position of the carriage;

an encoder sensor mounted on the carriage and configured to detect the position of the carriage by optically reading the counter of the linear encoder sheet;

a carriage unit enclosure in which at least the carriage, the linear encoder sheet, and the encoder sensor are disposed; and an internal pressure adjusting unit configured to adjust an internal pressure of the carriage unit enclosure to be other than a negative pressure.

2. The image forming apparatus according to claim 1, wherein the carriage unit enclosure includes an opening portion in an area corresponding to an area of movement of the printing head during the printing operation and a head maintenance operation.

3. The image forming apparatus according to claim 2, further comprising a shielding member configured to cover the opening portion while the carriage is moved.

4. The image forming apparatus according to claim 3, wherein the shielding member includes a bellows member.

5. The image forming apparatus according to claim 3, wherein the shielding member includes a sheet member.

6. The image forming apparatus according to claim 1, wherein the internal pressure adjusting unit includes a fan configured to supply air into the carriage unit enclosure.

7. The image forming apparatus according to claim 1, wherein the internal pressure adjusting unit is disposed on each side of the carriage unit enclosure with respect to the main scan direction, wherein the internal pressure adjusting unit disposed on the side away from which the carriage is moved is activated.

8. The image forming apparatus according to claim 1, wherein the internal pressure adjusting unit is activated for a period of time after the printing operation.

9. The image forming apparatus according to claim 1, wherein the carriage unit enclosure includes an open/close cover.

10. The image forming apparatus according to claim 9, wherein the open/close cover is formed by a part of an exterior member of the image forming apparatus.

* * * * *